US005906690A

United States Patent [19]

Engl et al.

[11] Patent Number: 5,906,690

[45] Date of Patent: May 25, 1999

[54] METHOD OF PRODUCING COLD-ROLLED, HIGH-STRENGTH STEEL STRIP WITH GOOD PLASTICITY AND ISOTROPIC PROPERTIES

[75] Inventors: Bernhard Engl; Klaus-Dieter Horn, both of Dortmund; Günter Stich, Bochum, all of Germany

[73] Assignee: Fried. Krupp AG Hoesch-Krupp, Essen, Germany

[21] Appl. No.: 08/767,112

[22] Filed: Dec. 4, 1996

[30] Foreign Application Priority Data

Dec. 16, 1995 [DE] Germany ..... 195 47 181

[51] Int. Cl.[6] ..... C21D 8/02

[52] U.S. Cl. ..... 148/537; 148/603; 148/651

[58] Field of Search ..... 148/537, 603, 148/651

[56] References Cited

U.S. PATENT DOCUMENTS 5,137,584 8/1992 Jesseman ..... 148/603
5,360,493 11/1994 Matsuoka et al. ..... 148/651

*Primary Examiner*—Deborah Yee
*Attorney, Agent, or Firm*—Max Fogiel

[57] ABSTRACT

A method of producing cold-rolled, high-strength steel strip with good plasticity and isotropic properties out of steel comprising no more than 0.08% carbon, no more than 10% silicon, no more than 1.8% manganese, between 0.010 and 0.10% phosphorus, no more than 0.02% sulfur, no more than 0.08% aluminum and no more than 0.008% nitrogen by weight plus one or more of the elements titanium, vanadium, niobium, and zirconium, the remainder being iron, by hot rolling, cold rolling, and recrystallization annealing; followed by temper rolling. The steel contains either three times as much titanium or six times as much niobium or zirconium as nitrogen.

5 Claims, 5 Drawing Sheets

CONTINUOUS ANNEALING

| Steel No. | C % | Si % | Mn % | P % | S % | Al % | N % | Ti % | Nb % | V % |
|---|---|---|---|---|---|---|---|---|---|---|
| 1 | 0.003 | 0.01 | 0.17 | 0.008 | 0.005 | 0.021 | 0.0029 | 0.012 | 0.010 | – |
| 2 | 0.003 | 0.01 | 0.19 | 0.009 | 0.007 | 0.030 | 0.0023 | – | 0.023 | – |
| 3 | 0.003 | 0.02 | 0.18 | 0.011 | 0.004 | 0.031 | 0.0031 | – | – | 0.031 |
| 4 | 0.003 | 0.01 | 0.17 | 0.068 | 0.003 | 0.033 | 0.0021 | 0.0021 | 0.012 | – |
| 5 | 0.037 | 0.02 | 0.19 | 0.008 | 0.012 | 0.041 | 0.0031 | 0.011 | – | – |
| 6 | 0.047 | 0.02 | 0.16 | 0.011 | 0.013 | 0.035 | 0.0046 | 0.025 | – | – |
| 7 | 0.052 | 0.01 | 0.18 | 0.014 | 0.011 | 0.033 | 0.0041 | 0.038 | – | – |
| 8 | 0.054 | 0.01 | 0.19 | 0.009 | 0.007 | 0.040 | 0.0034 | – | 0.025 | – |
| 9 | 0.062 | 0.02 | 0.17 | 0.073 | 0.008 | 0.045 | 0.0048 | 0.044 | – | – |

*Table 1* CHEMICAL COMPOSITION IN % BY WEIGHT

Fig. 3

*Table 2*

WET = FINAL ROLLING TEMPERATURE
HT = COILER TEMPERATURE
GT = ANNEALING TEMPERATURE

| Stahl Nr. | WET C | HT C | ANNEALING | GT C |
|---|---|---|---|---|
| 1.1 | 810 | 730 | Conti | 800 |
| 2.1 | 815 | 715 | Conti | 800 |
| 3.1 | 800 | 705 | Conti | 800 |
| 4.1 | 820 | 725 | Conti | 800 |
| 5.1 | 800 | 695 | Conti | 800 |
| 6.2 | 795 | 705 | Batchwise | 650 |
| 7.1 | 810 | 730 | Conti | 800 |
| 7.2 | " | " | Batchwise | 650 |
| 7.2.1 | 800 | 600 | Batchwise | 650 |
| 8.2 | 815 | 735 | Batchwise | 650 |
| 9.1 | 825 | 725 | Conti | 800 |

Fig. 4

ARe = STRETCH THRESHOLD EXPANSION
D° = TEMPER-ROLLING DEGREE
Rp0.2 = 0.2% YIELD POINT
Rm = TENSILE STRENGTH
AB0 = BREAK POINT
BH0 = BAKE-HARDENING 0% STRETCHED
nm = REINFORCEMENT EXPONENT
rm = PERPENDICULAR ANISOTROPY
ΔR = PLANE ANISOTROPY
Km = GRAIN SIZE

| Steel No. | ARe % | D° % | Rp0.2 MPa | Rm MPa | A80 % | BH0 MPa | nm – | rm – | Δr – | Km ASTM |
|---|---|---|---|---|---|---|---|---|---|---|
| 1.1 | 7 | 0.6 | 189 | 313 | 39 | 58 | 0.21 | 1.57 | 0 | 8 |
| 2.1 | 9 | 0.8 | 211 | 334 | 37 | 55 | 0.20 | 1.65 | −0.09 | 9 |
| 3.1 | 6 | 0.6 | 182 | 309 | 39 | 65 | 0.21 | 1.40 | 0.09 | 8 |
| 4.1 | 8 | 0.8 | 242 | 351 | 36 | 62 | 0.20 | 1.48 | 0.07 | 8–9 |
| 5.1 | 7 | 0.8 | 231 | 345 | 36 | 56 | 0.19 | 0.92 | −0.06 | 9 |
| 6.2 | 9 | 0.9 | 225 | 341 | 38 | – | 0.22 | 1.05 | 0.08 | 9 |
| 7.1 | 10 | 1.1 | 286 | 393 | 33 | 46 | 0.18 | 0.93 | −0.07 | 10–11 |
| 7.2 | 9 | 1.0 | 248 | 369 | 36 | – | 0.21 | 0.99 | −0.03 | 10 |
| 7.2.1 | 10 | 1.1 | 260 | 362 | 35 | – | 0.20 | 0.80 | −0.43 | 10–11 |
| 8.2 | 11 | 1.1 | 263 | 378 | 34 | – | 0.20 | 1.12 | −0.09 | 10–11 |
| 9.1 | 10 | 1.2 | 334 | 436 | 32 | 43 | 0.18 | 0.90 | −0.02 | 10 |

*Table 3* MECHANICAL PROPERTIES, TEMPER-ROLLING DEGREE, AND GRAIN SIZE OF 70% COLD-ROLLED STRIP

Fig. 5

METHOD OF PRODUCING COLD-ROLLED, HIGH-STRENGTH STEEL STRIP WITH GOOD PLASTICITY AND ISOTROPIC PROPERTIES

BACKGROUND OF THE INVENTION

The present invention concerns a method of producing cold-rolled, high-strength steel strip with good plasticity and isotropic properties as recited in the preamble to claim 1. Such steels and their composition are state of the art.

Cold-rolled steel strip is employed to manufacture a wide range of cold-formed products. Various forming procedures require steels with different properties.

The increasingly exacting demands of engineering and industry require better and better mechanical properties (characteristics), especially plasticity. Plasticity is defined by the highest possible r, n, and expansion, whereby r represents deep drawing, n stretching, and expansion planar strain.

It has been demonstrated practical for plasticity to be as equal as possible along the different directions, especially longitudinal, transverse, and diagonal, extensively isotropic in other words. When r is isotropic, Δr will be very low, and rotationally symmetrical pressings will be extensively free of ears. The advantages of isotropy are particularly expressed in uniform rheology and less waste.

Light-weight structural engineering is also an expanding field and demands thinner sheet metals. The sheet must be stronger to compensate.

To minimize the unavoidable decrease in plasticity that accompanies increased strength is accordingly a major goal of materials science.

A wide range of high-strength steels appropriate for cold forming is available at the state of the art. The present situation with respect to micro-alloyed and P-alloyed steels, bake-hardened or not, is essentially described in Stahl-Eisen-Werkstoffblatt 093 and 094. Bake-hardened properties can be particularly well brought out by one of the new continuous heat treatments, sometime in conjunction with hot dipping. Clean strip with uniform properties can easily be obtained.

Isotropy has long been easy to obtain. Rotationally symmetric pressings from an isotropic material will not have ears. One example is described in the Brockhaus B-Faktor advertisement in Der Spiegel, 19 (1966), 125. This example, however, does not expressly address the production of high-strength steel and requires either very special cold rolling or even standardizing annealing to eliminate ears.

A high-strength thin-sheet steel alloyed with titanium to eliminate ears has very recently become known from German Patent 3 803 064. The process is limited, however, to batchwise annealing and accordingly lacks the advantages of continuous annealing and of the finish provided by dipping. The potential for increasing such strength characteristics as yield point to approximately 220 to 280 N/mm$^2$ is also limited. Another drawback is the strictly low r of 1.0, which is detrimental to deep drawing. Again, the high strength is essentially attained by the mechanism of compaction through reducing the grain size. A small grain means comparatively expensive temper rolling. Regular temper rolling entails the risk of flow lines and hence the failure of outer-skin areas. The relatively careful temper rolling necessary in the present event, however, is more detrimental to plasticity than ordinary temper rolling is.

Limitation to the almost exclusive effect of grain-size reduction by way of titanium also necessitates the precise matching of hot-rolling, cold-rolling, and annealing conditions to the particular chemistry, accompanied by high demands for precision. Another drawback is the restriction of final rolling temperatures to above $A_{r3}$, whereby the rolling of strip with low final thickness is in particular more difficult because of the associated higher temperature loss.

SUMMARY OF THE INVENTION

This is the point of departure for the present invention. The method in accordance with the present invention is appropriate for obtaining yield points ranging between 200 and 420 N/mm$^2$. The mechanical properties are isotropic. Further embodiments can be employed to obtain even higher r, making bake hardening possible. Furthermore, the advantages of continuous annealing or hot dipping can be exploited. The advantages of the present invention, finally, can be obtained with titanium, niobium, vanadium, or zirconium German Patent 3 803 064 describes production that maintains a final rolling temperature above $A_{r3}$, The conditions that allow the advantages of a low final rolling temperature to be exploited have accordingly not been understood until now.

The present invention combines a low final rolling temperature with a high coiler temperature. The surprising result is properties and characteristics unknown until now in isotropic steels—less scaling during hot rolling and less expensive temper rolling for thin sheet.

The present invention makes it possible to produce isotropic steel strip not only batchwise but continuously. It also permits bake hardening and hot dipping.

Surprisingly, vacuum decarbonization in the plant and continuous annealing of the cold strip can in addition to bake hardening also result in a higher r.

BRIEF DESCRIPTION OF THE DRAWINGS

FIG. 3 is a table listing chemical compositons of various steels

FIG. 4 is a table illustrating the conditions under which steels are produced.

FIG. 5 is a table representing the mechanical qualities of steel

DESCRIPTION OF THE PREFERRED EMBODIMENT

The present invention will now be specified with reference to examples.

FIG 3. lists the chemical compositions of various steels, The steels are alloyed with enough titanium, niobium, or vanadium for stoichiometric nitrogen elimination. Steels 4 and 9 are also alloyed with phosphorus to increase strength.

FIG 4. illustrates the conditions under which the steels are produced. The combination of a final rolling temperature below $A_{r3}$ and coiler temperature above 650° C. in accordance with the present invention is represented.

FIG 5. represents the mechanical qualities, the temper-rolling degree, and the grain size of steels from 70% cold-rolled strip. The present invention makes it possible to obtain a cold-strip temper-rolling degree approximately ⅓ lowers Furthermore, it was possible to obtain high $r_m$'s (1.4–1.65) at low $\Delta_r$'s (<±0.1) in the vacuum-decarbonized steels 1 through 4.

Figure 1:
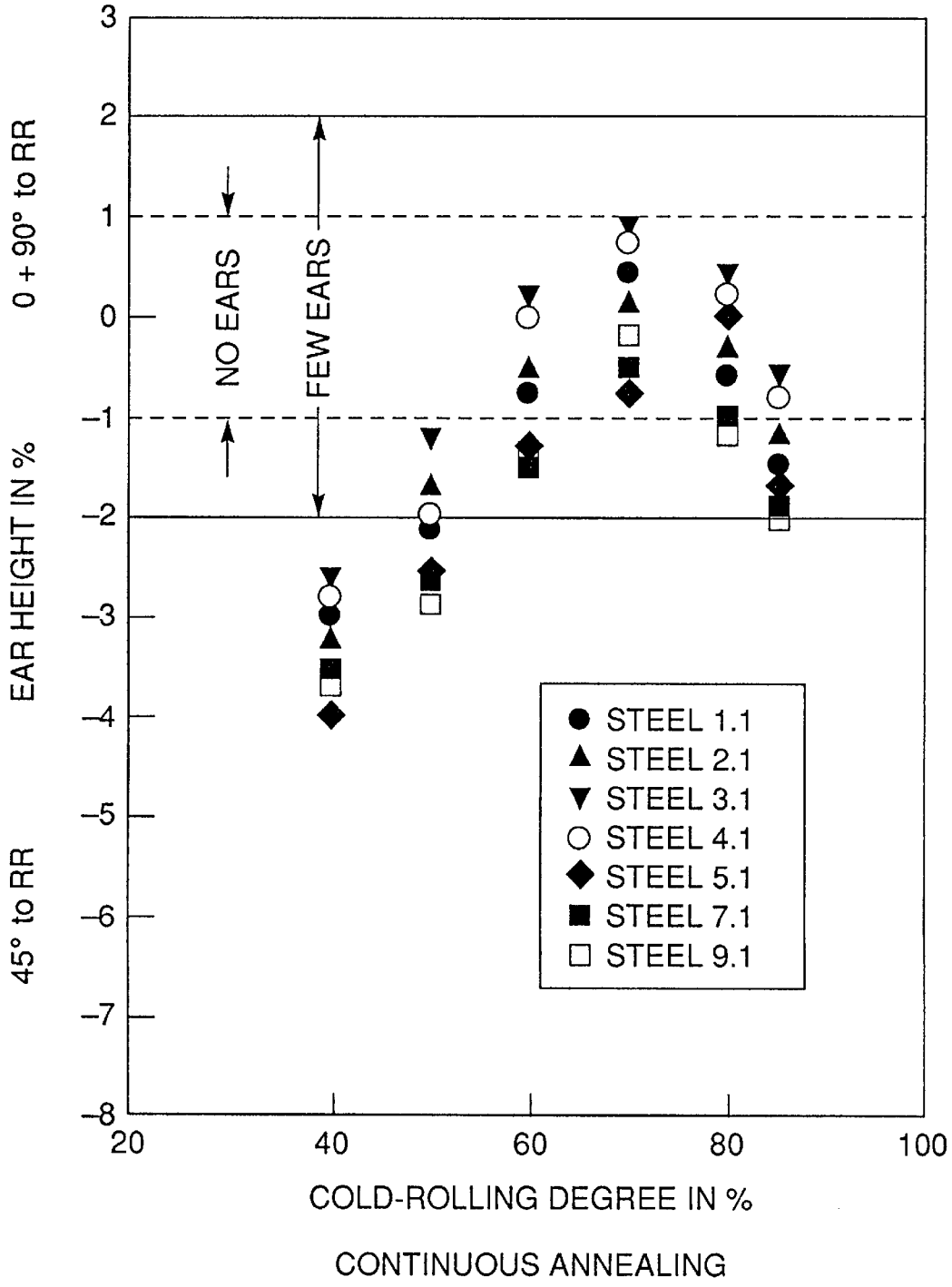
FIG. 1 is a graph illustrating ear height over cold-rolling degree for continuously annealed steels.
Figure 2:
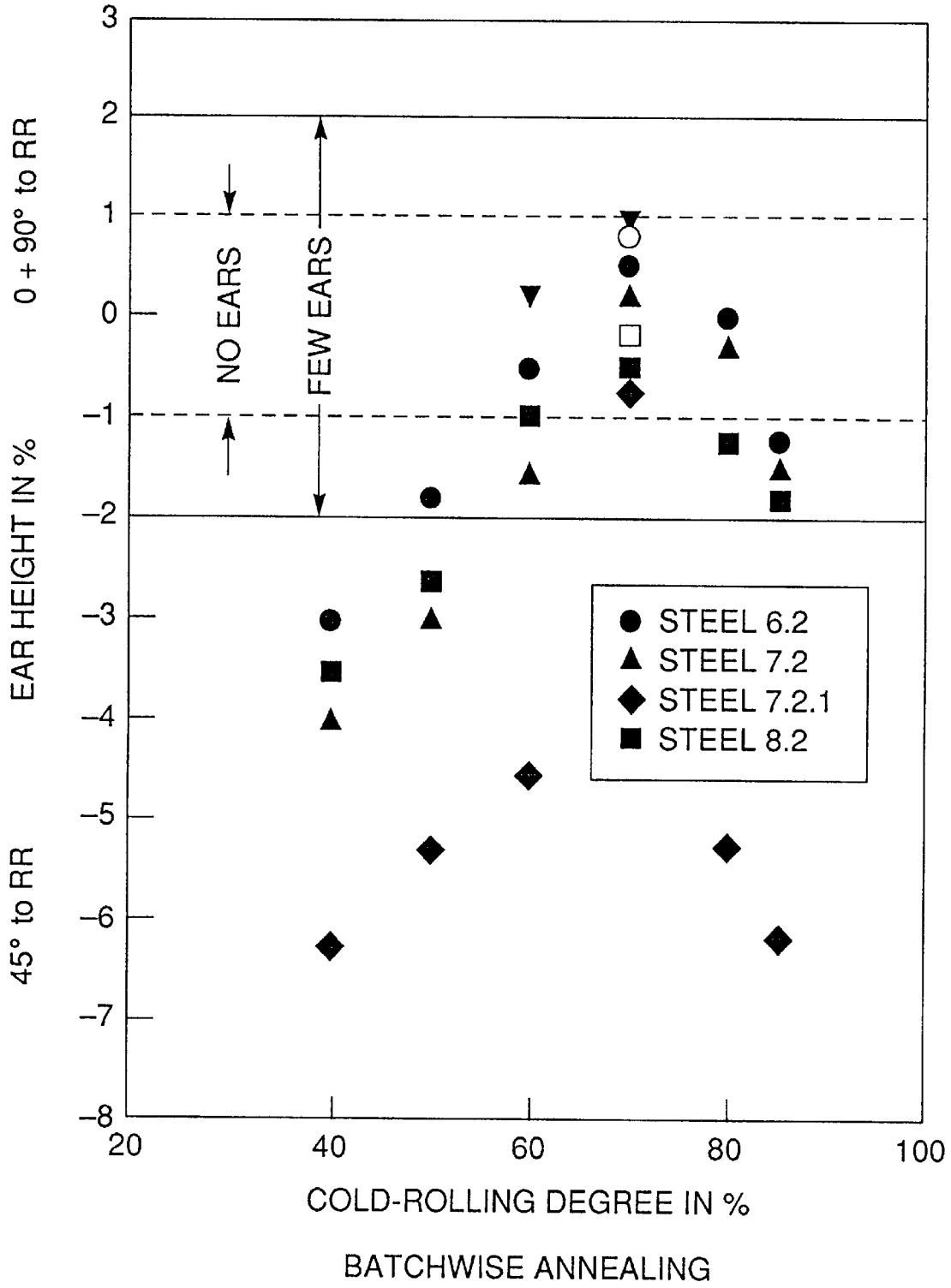
FIG. 2 is a graph illustrating ear height over cold-rolling degree for batchwise annealed steels.

FIGS. 1 and 2 are graphs illustrating ear height over cold-rolling degree FIG. 1 for the continuously annealed steels and FIG. 2 for the batchwise annealed steels. It will be evident that both the continuously and the batchwise annealed steels yield low-ear strip at cold-rolling degrees between 50 and 85%. The examples for the degree of approximately 70% conventional for cold rolling were all free of ears.

It will also be evident from FIG. 2 that a coiler temperature (600° C. for steel 7.2.1) lower than that in accordance with the present invention results in considerable earing This emphasizes the need for the combination of high coiler temperature and low final rolling temperature in accordance with the present invention

We claim:

1. A method of producing cold-rolled, high-strength steel strip with good plasticity and isotropic properties out of steel comprising 0.015 to 0.08% carbon, no more than 1.0% silicon, no more than 1.8% manganese, between 0.010 and 0.010% phosphorus, no more than 0.02% sulfur, no more than 0.08% aluminum, and no more than 0.008% nitrogen by weight plus one or more of the elements titanium, vanadium, niobium, and zirconium, the remainder being iron, comprising the steps of: hot rolling, cold rolling, and recrystallization annealing; temper rolling thereafter, the steel containing thereby either three times as much titanium or six times as much niobium or zirconium as nitrogen; casting the steel into slabs; heating said slabs prior to hot rolling to at least 1000° C.; rolling said slabs into hot strip at a final rolling temperature less than $A_{r3}$ and coiling said strip at a coiler temperature above 650° C.; said cold rolling subsequently to said hot rolling occurring at a degree of 55 to 85%; and following said recrystallization annealing and temper rolling whereby the steel's yield point is at least 200 $N/mm^2$ subsequent to simulated enamel baking, and carrying out said enamel baking treatment for at least 20 minutes at at least 170° C.

2. A method as defined in claim 1, wherein said steel is batchwise recrystallization annealed subsequent to cold rolling.

3. A method as defined in claim 1, wherein said steel is continuously recrystallization annealed subsequent to cold rolling.

4. A method as defined in claim 1, wherein said steel contains 0.035 to 0.10% phosphorus.

5. A method as defined in claim 1, wherein the final hot-rolling temperature is less than 850° C.

* * * * *